United States Patent [19]

Odell et al.

[11] Patent Number: 4,988,916

[45] Date of Patent: Jan. 29, 1991

[54] DISCHARGE ARC LAMP

[75] Inventors: Edwin C. Odell; Martin G. Scott, both of Oadby, England

[73] Assignee: Thorn EMI plc, London, England

[21] Appl. No.: 341,188

[22] Filed: Apr. 21, 1989

[30] Foreign Application Priority Data

Apr. 22, 1988 [GB] United Kingdom ..... 8809577

[51] Int. Cl.[5] ..... H01J 17/18; H01J 61/36

[52] U.S. Cl. ..... 313/623; 313/625

[58] Field of Search ..... 313/623, 624, 625

[56] References Cited

U.S. PATENT DOCUMENTS 4,780,646 10/1988 Lange ..... 313/623

FOREIGN PATENT DOCUMENTS 1152134 5/1969 United Kingdom .
1485459 9/1977 United Kingdom .
1566370 4/1980 United Kingdom .
2191337A 12/1987 United Kingdom .

*Primary Examiner*—Sandra L. O'Shea
*Attorney, Agent, or Firm*—Fleit, Jacobson, Cohn, Price, Holman & Stern

[57] ABSTRACT

In a discharge arc lamp, an arc tube comprises an arc tube body and a main electrode at each end inside of the arc tube body, between which in the operating condition of the lamp a discharge takes place. At each end of the arc tube is an end closure comprising an end plug joined to respective each end and a cap member, the end plug and the cap member having facing surfaces. A seal provided by sealing means to seal the cap member to the end plug includes an annular seal portion between the facing surfaces of the end plug and the cap member. One or both of the facing surfaces is so shaped that the annular seal portion has a predetermined and uniform thickness t.

9 Claims, 5 Drawing Sheets

DISCHARGE ARC LAMP

This invention relates to a discharge arc lamp, particularly, though not exclusively, to a ceramic metal halide (CMH) lamp. In particular, this invention relates to the sealing of discharge arc tubes in such lamps.

FIG. 1 is a schematic representation of a known construction for the end of a discharge arc tube for a CMH lamp. At one end of an arc tube body 10 of ceramic material is sintered an end plug 12. A cermet cap 14 is sealed to the end plug 12 by a glass seal 15. In the cermet cap 14 is set an electrode shank 16 carrying an electrode structure (not shown) and a lead-in wire 18.

A problem has arisen with such an end construction in that if, in the sealing process, the cermet cap 14 is firmly pressed onto the end plug 12, the resulting glass seal 15 is formed of a very thin fillet of glass. Any bubbles trapped within the glass seal are therefore elongated and can extend from the outside edge of the seal 15 to the inside of the arc tube body 10, thus creating a leakage path for the contents of the arc tube.

One solution to this problem has been to not fully load the cermet cap 14 onto the end plug 12, and so produce a glass seal 15 having a greater thickness. However, if the loading is not applied precisely along the arc tube axis, cap tilting can occur, producing a wedge-shaped seal which, at its thinnest edge, can give rise to a leaky seal. Furthermore, the thickness of the seal produced, and consequently the height of the cermet cap relative to the arc tube end and the separation of the electrodes, is variable, giving rise to a variable lamp performance.

It is an object of the present invention to provide a different form of end construction for a discharge arc tube which at least alleviates the problems described herein.

According to a first aspect of the present invention, there is provided an arc tube for a discharge arc lamp, said arc tube comprising an arc tube body and a main electrode at each end inside of said arc tube body, between which in the operating condition of the lamp a discharge takes place;

said arc tube further comprising at each end an end closure: said end closure comprising an end plug joined to respective said end and a cap member, the end plug and the cap member having facing surfaces;

wherein a seal provided by sealing means to seal said cap member to said end plug includes an annular seal portion between the facing surfaces of said end plug and said cap member, one or both of said facing surfaces being so shaped that said annular seal portion has a predetermined and uniform thickness.

A discharge arc tube provided in accordance with the present invention has end closures including a hermetic seal of a predetermined and uniform thickness. Any small inclusions (bubbles) in the sealing means are not sufficiently elongated by too great an applied pressure in the sealing process, and so a leakage path is not created. Furthermore, the cap member and end plug may be firmly pressed together when the glass seal is formed.

Preferably said cap member is made of a cermet material.

Preferably the facing surface of said end plug has a step defining an annular projection. The thickness of the annular projection of the end plug determines the height of the cap relative to the arc tube end and hence the separation of the electrodes which may be kept constant from tube to tube, giving rise to a less variable performance in lamps produced.

The present invention also provides a discharge arc lamp comprising an arc tube in accordance with the first aspect of the present invention.

Embodiments of the invention will now be described, by way of example and with reference to the accompanying drawings, in which.

Figure 1:
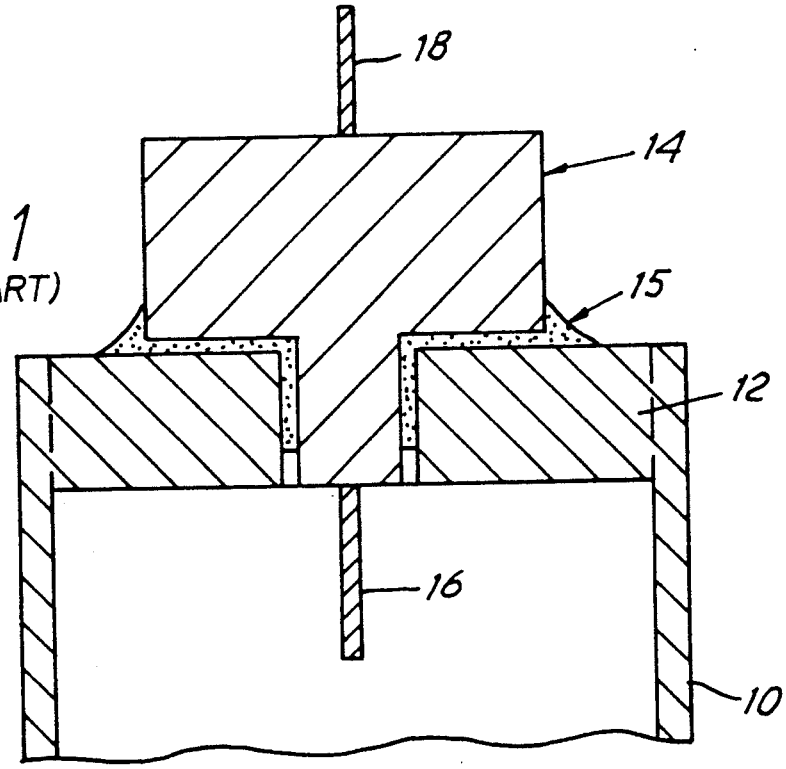
FIG. 1 (PRIOR ART)
FIG. 1 shows, in longitudinal section, an end of a known discharge arc tube having a cermet cap.
Figure 2:
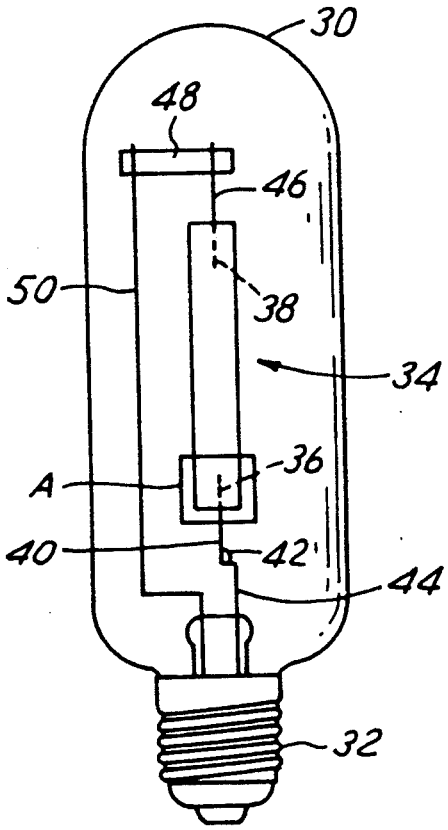
FIG. 2 shows a discharge arc lamp with a discharge arc tube provided in accordance with the present invention.
Figure 3:
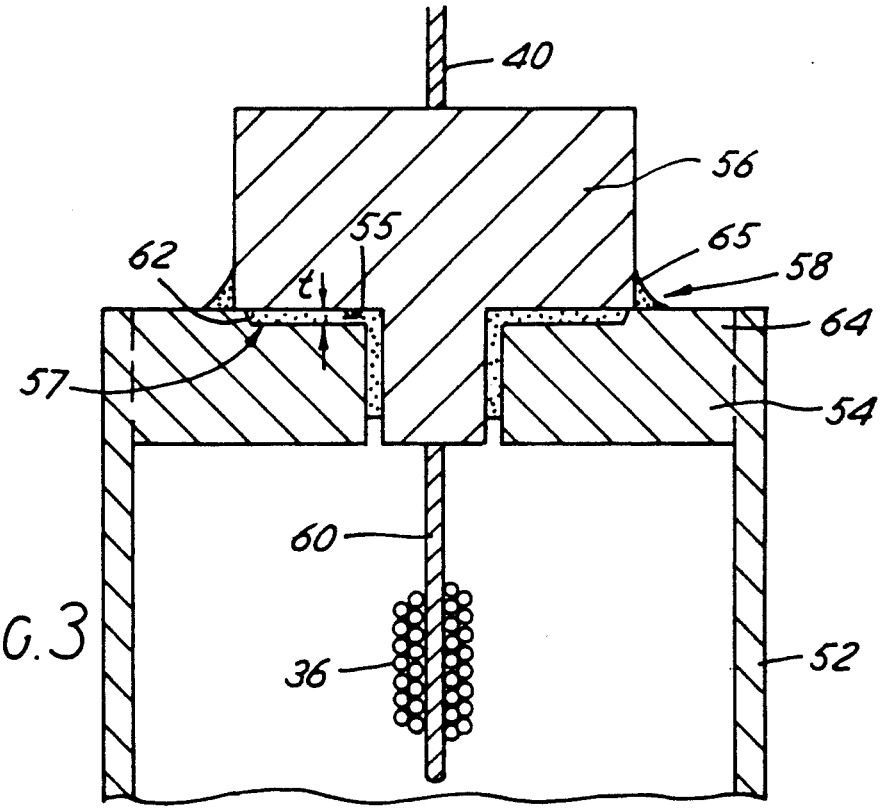
FIG. 3 shows, in longitudinal section and on an enlarged scale, a first embodiment of the end of the discharge arc tube of FIG. 2 generally indicated in FIG. 2 by the box A.
Figure 5:
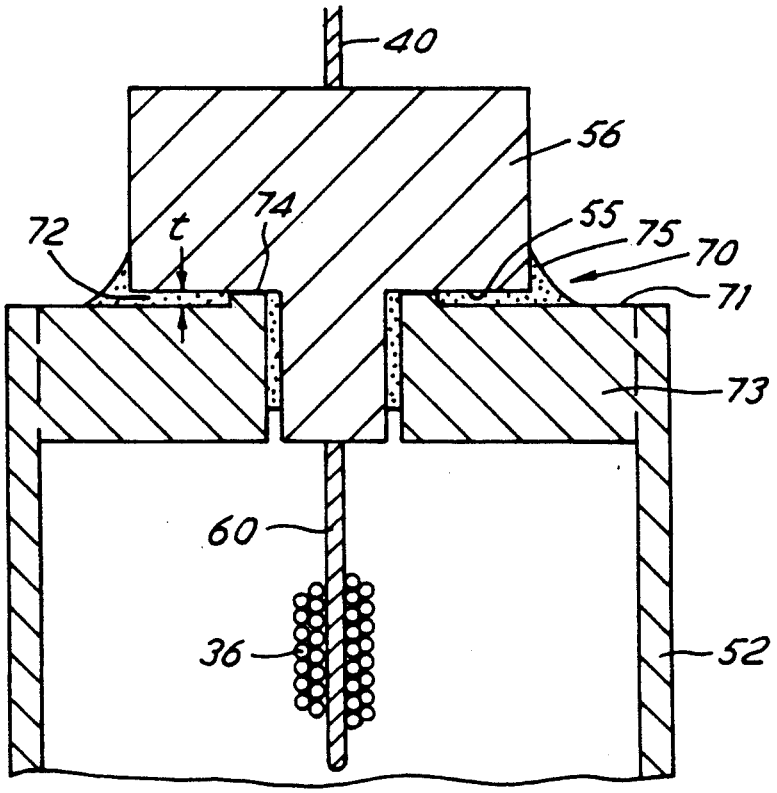
Figure 4A:
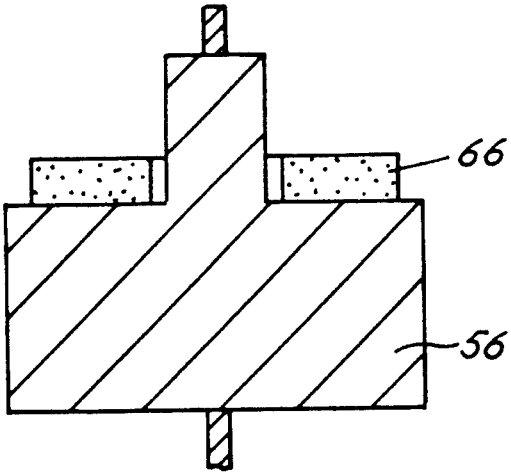
Figure 4B:
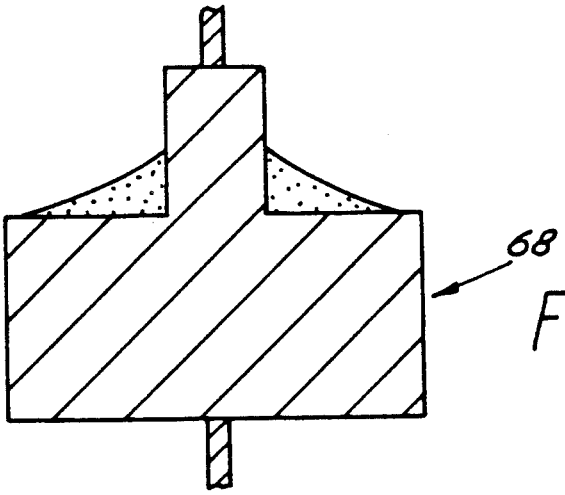
Figure 4C:
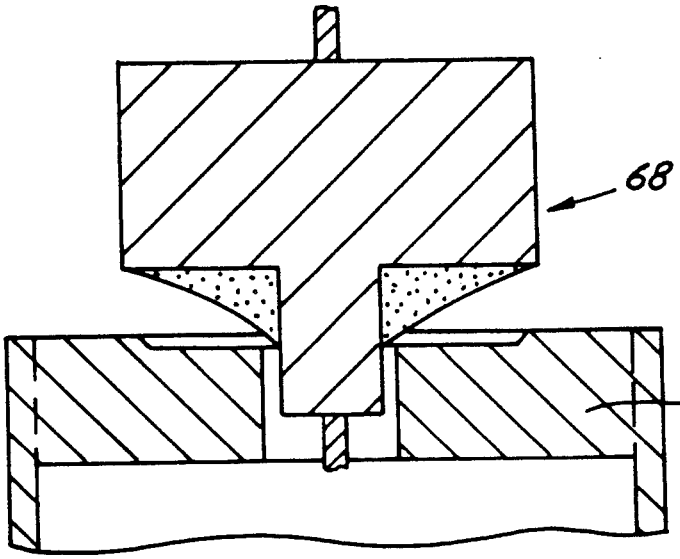
Figure 6A:
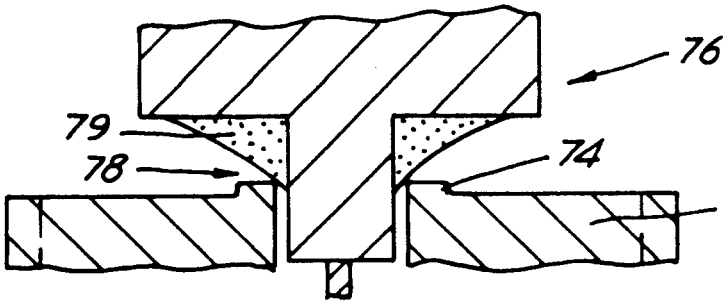
Figure 6B:
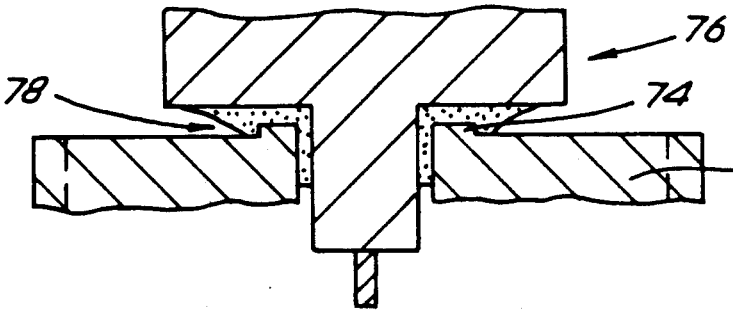
Figure 6C:
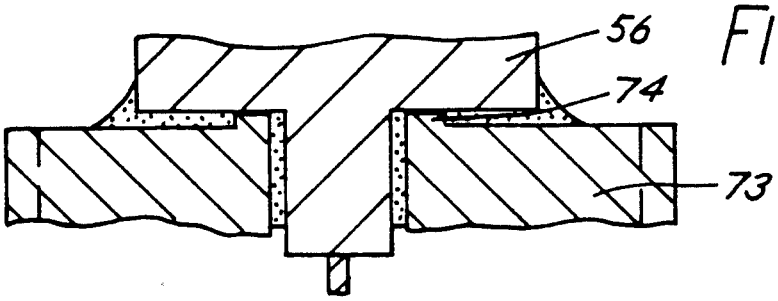
Figure 7:
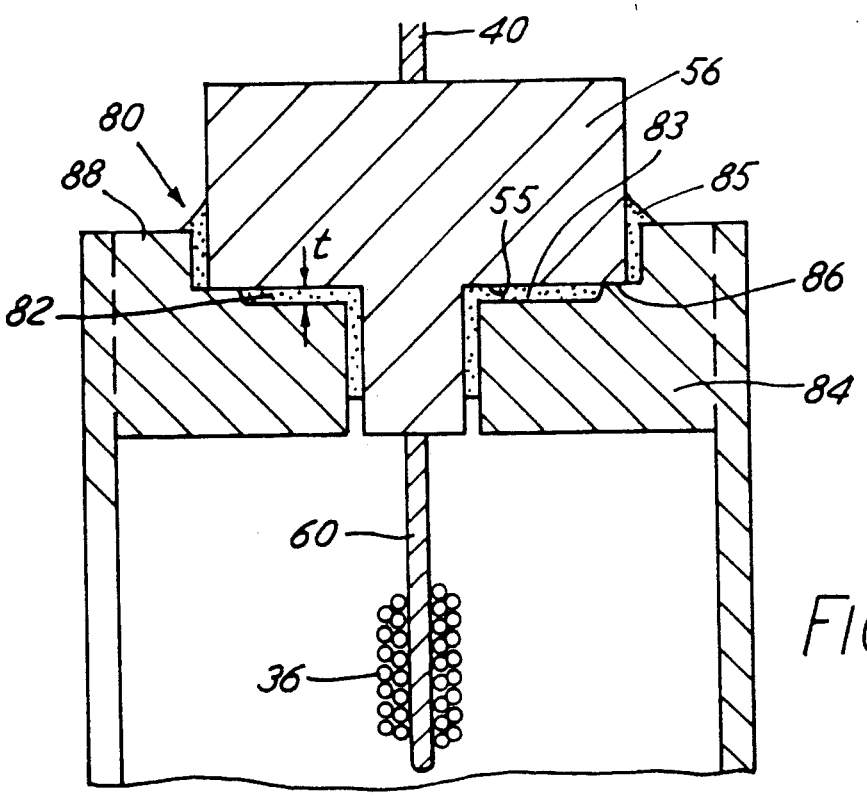
Figure 8:
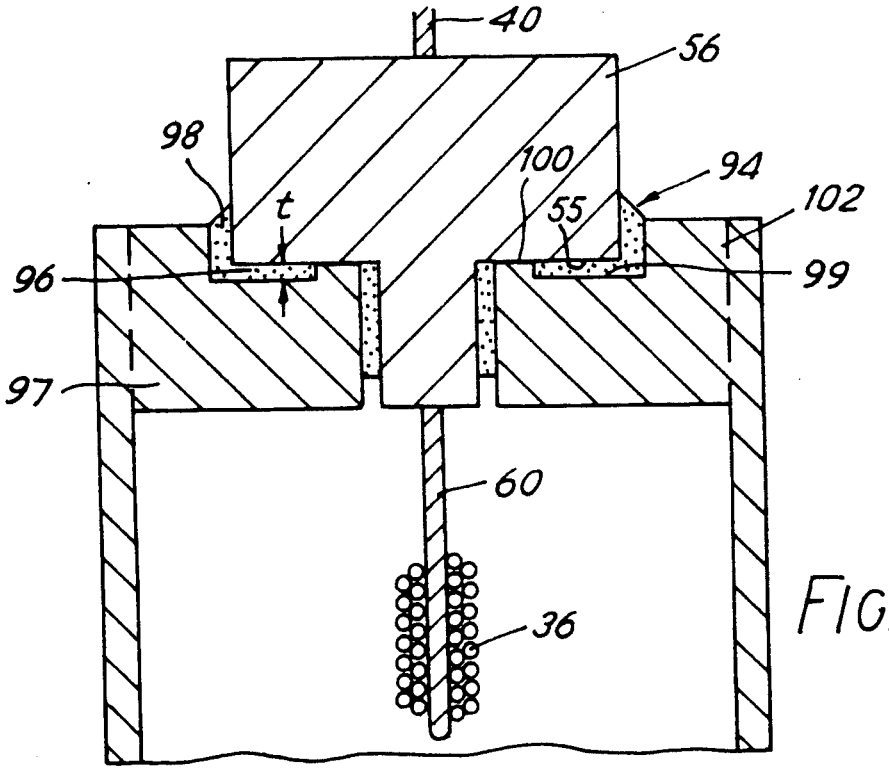

FIGS. 4*a* to 4*c* show, schematically, stages in the formation of a glass seal for the end of the discharge arc tube of FIG. 3;

FIG. 5 shows, in longitudinal section and on an enlarged scale, a second embodiment of the end of the discharge arc tube of FIG. 2 generally indicated in FIG. 2 by the box A;

FIGS. 6*a* to 6*c* show, schematically stages in the formation of a glass seal for the end of the discharge arc tube of FIG. 5;

FIGS. 7 and 8 show in longitudinal section and on an enlarged scale, further embodiments of the end of the discharge arc tube of FIG. 2 generally indicated in FIG. 2 by the box A.

FIG. 2 shows a ceramic metal halide discharge arc lamp having an outer bulb 30 and lamp cap 32. Within the outer bulb 0 is situated a discharge arc tube 34 of circular cross-section provided with two main electrodes 36, 38. The main electrode 36 is connected to a lead-through element 40 which is electrically connected through a flexible conductor 42 to a rigid current conductor 44. The main electrode 38 is connected to a lead-through element 46 which is electrically connected through an auxilliary conductor 48 to a rigid current conductor 50.

FIG. 3 shows the construction of the end of the arc tube 34, indicated generally by the box in FIG. 2, in greater detail. The arc tube 34 comprises an arc tube body 52 of ceramic material to which is sintered an end plug 54, also of ceramic material. Facing surfaces 55, of a cermet cap 56, and 57, of the end plug 54, are sealed together by a glass seal 58. Set into the cermet cap 56 is the lead-through element 40 and an electrode shank 60 carrying the main electrode 36.

The glass seal 58 includes an annular seal portion 62 between the facing surfaces 55 and 57 of the cermet cap 56 and the end plug 54, the annular seal portion 62 being of a predetermined and uniform thickness t (as indicated in FIG. 3). It has been found that for a leak-free seal, made of a magnesium alumino silicate glass, which may include a titania dopant, the optimum seal thickness is in the range of from 100 μm to 300 μm, preferably in the range of from 130 μm to 160 μm. The thickness of the annular seal portion 62 is defined by a step presented by an annular projection 64 extending from the facing surface 57 of the end plug 54. The annular projection 64 of the end plug 54, is radially outwards of the annular seal portion 62. The glass seal 58 also includes an outer seal 65.

FIG. 4 shows, schematically, stages in the formation of the glass seal 58 in a preferred, but non-limiting, method. A frit ring 66, as shown in FIG. 4*a* is placed in position on a cermet cap 56, and heated to produce what is termed a 'premelt cap' 68 as shown in FIG. 4*b*. Finally, as shown in FIG. 4*c*, the premelt cap 68 is then firmly pressed onto the end plug 54 of an arc tube while heat is applied to form the glass seal 58. The annular projection 64 of the end plug 54 ensures that the seal 58 includes an annular seal portion of predetermined and uniform thickness.

The details of construction and formation of the other end of the discharge arc tube 34 enclosing the other main electrode 38 are similar to those outlined above for the end of the discharge arc tube 34 enclosing the main electrode 36.

In a second embodiment shown in FIG. 5, parts corresponding to those in FIG. 3 are designated by like reference numerals. The glass seal 70 includes an annular seal portion 72 of predetermined and uniform thickness t between the facing surfaces 55, of the cermet cap 56, and 71, of an end plug 73. In this embodiment a step presented by an annular projection 74 formed as part of the end plug 73 is radially inwards of the annular seal portion 72. The thickness of the annular projection 74 of the end plug 73 defines the thickness of the annular seal portion 72. The glass seal 70 also includes an outer seal 75.

The production of a glass seal 70 in which the annular seal portion 72 of predetermined and uniform thickness is external of the annular projection 74 of the end plug 73 has advantages when a premelt cap is used. FIG. 6 shows schematically stages in the formation of such a seal 70. As shown in FIG. 6*a*, when a premelt cap 76 is applied to an end plug 73, because of the shape of the meniscus of the glass 79 around the cap 56, there is a gap 78 between the glass 79 and the annular projection 74 of the end plug 73 and hence the possibility of a gas bubble being trapped in the glass of the seal. However, because of the shape of the end plug 73, as the premelt cap 76 is applied to the end plug 73, the gap 78 is moved outward of the cap as shown in FIG. 6*b* and hence there is less likelihood of a gas bubble being trapped. FIG. 6*c* shows the fully assembled end closure with the gap 78 eliminated.

In a third embodiment shown in FIG. 7, parts corresponding to those in FIG. 3 are designated by like reference numerals. The glass seal 80 includes an annular seal portion 82, between facing surfaces 55, of the cermet cap 56, and 83, of an end plug 84, and an outer seal 85. The end plug 84 has an annular projection 86 to define the thickness t of the annular seal portion 82 and another annular projection 88 partially enclosing the cap 56. Accordingly the outer seal 85 produced is longer and more reliable than the outer seal 65 of the first embodiment shown in FIG. 3.

FIG. 8 shows a fourth embodiment, parts corresponding to those in FIG. 5 being designated by like reference numerals. The glass seal 94 includes an annular seal portion 96 between the facing surfaces 55, of the cermet cap 56, and 99, of an end plug 97, and an outer seal 98. The end plug 97 has an annular projection 100 to define the thickness t of the annular seal portion 96 and another annular projection 102 partially enclosing the cap 56. Accordingly the outer seal 98 produced is longer and more reliable than the outer glass seal of the embodiment shown in FIG. 5.

The annular projections 64, 74, 86, 88, 100, 102 of the end plug 54, 73, 84, 97 may be simply produced by using a suitably contoured press tool face.

It is envisaged that the thickness of the annular seal portion may be defined by one or more steps in the facing surface 55 of the cermet cap 56, instead of by the step or steps in the end plug 54, 73, 84, 97 as described, or by provision of steps in the facing surfaces of both the cap and the end plug.

It will be appreciated that although the present invention has been described with reference to a ceramic metal halide discharge arc lamp in which the arc tube is closed by cermet caps, the invention has wider applicability to discharge arc lamps generally.

We claim:

1. An arc tube for a discharge arc lamp, said arc tube comprising an arc tube body and main electrodes, one a each end of and inside said arc tube body, between which in the operating condition of the lamp a discharge takes place, said arc tube further comprising at each end thereof an end closure wherein at least one said end closure comprises;

(a) an end plug joined to the respective end, and having a first surface, (b) a cap-member having a second surface facing said first surface to define a region therebetween.

(c) sealing means adapted to seal said cap member to said end plug comprising sealing material located over at least one part of said region, (d) spacing means located at at least one further part of said region, adapted to separate said surfaces at said at least one part by a predetermined and uniform spacing to provide a desired thickness of said sealing material.

2. An arc tube according to claim 1 wherein said cap member is made of a cermet material.

3. An arc tube according to claim 1 wherein one or both of said facing surfaces has a step defining an annular projection.

4. An arc tube according to claim 3 wherein said annular projection is radially outwards of said annular seal portion.

5. An arc tube according to claim 3 wherein said annular projection is radially inwards of said annular seal portion.

6. An arc tube according to claim 3 wherein another annular projection extends from one or both of said facing surfaces, said another annular projection being external of said annular projection and partially enclosing said cap member.

7. An arc tube according to claim 1 wherein said thickness of said annular seal portion is in the range of from 100 μm to 300 μm.

8. An arc tube according to claim 7 wherein said thickness of said annular seal portion is in the range of from 130 μm to 160 μm.

9. An arc tube according to claim 1 wherein said spacing means is formed by shaping one or both of said facing surfaces.

* * * * *